US006694626B2

(12) United States Patent
Kludjian et al.

(10) Patent No.: US 6,694,626 B2
(45) **Date of Patent: *Feb. 24, 2004**

(54) RAZOR

(75) Inventors: David Kludjian, Marina del Rey, CA (US); Alon Leon Coresh, Marina del Rey, CA (US)

(73) Assignee: Rolling Razor LLC, Marina del Rey, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/023,000

(22) Filed: Dec. 17, 2001

(65) Prior Publication Data

US 2002/0050065 A1 May 2, 2002

Related U.S. Application Data

(63) Continuation-in-part of application No. 09/603,816, filed on Jun. 23, 2000, now Pat. No. 6,493,950.

(51) Int. Cl.[7] ..... B26B 21/52
(52) U.S. Cl. ..... 30/526; 30/298
(58) Field of Search ..... 30/50, 34.1, 47, 30/52 L, 298

(56) References Cited

U.S. PATENT DOCUMENTS

| | | | | | |
|---|---|---|---|---|---|
| 1,201,317 | A | | 10/1916 | Lishawa | |
| D146,759 | S | * | 5/1947 | Brown | 30/526 |
| 4,501,066 | A | | 2/1985 | Sceberras | |
| 4,989,328 | A | | 2/1991 | Sokoloff | |
| 5,009,003 | A | | 4/1991 | Grange | |
| 5,727,328 | A | * | 3/1998 | Kim | 30/526 |
| 5,865,189 | A | | 2/1999 | Andrews | |
| 6,018,877 | A | | 2/2000 | Greene | |
| 6,141,875 | A | * | 11/2000 | Andrews | 30/50 |

FOREIGN PATENT DOCUMENTS

| | | |
|---|---|---|
| EP | 0878274 A1 | 11/1998 |
| GB | 2265105 A | 9/1993 |

* cited by examiner

*Primary Examiner*—Douglas D. Watts
(74) *Attorney, Agent, or Firm*—Blakely, Sokoloff, Taylor & Zafman LLP

(57) ABSTRACT

A shaving device that defines a substantially cylindrical volume to receive an index finger of a user. Rotation about the index finger under control of the adjacent thumb and middle finger provide precise finger-tip control of the pitch, angle and pressure applied the fixed or replaceable shaving blades.

17 Claims, 8 Drawing Sheets

RAZOR

CROSS REFERENCE TO A RELATED APPLICATION

This is a continuation-in-part of Ser. No. 09/603,816 filed Jun. 23, 2000 and entitled "Rolling Razor and Shaving Method," now U.S. Pat. No. 6,493,950.

BACKGROUND OF THE INVENTION

1. Field of the Invention

The invention relates to shaving razors. More particularly, the invention relates to an improved razor with a handle rotatable about a user's finger.

2. Background

Razors for shaving, both disposable razors and cartridge systems, are well known in the art. A commonality found in the prior art is the elongated handle, it may be wide, it may be narrow and it is often surfaced for better gripping, but the razor head, whether it be single, dual or triple blades is supported on an elongated substantially stick-like member such as those illustrated in U.S. Pat. Nos. 4,026,016 issued to Nissen and U.S. Pat. No. 5,953,824 issued to Ferraro.

Dual headed razors are found in the art. U.S. Pat. No. 4,989,328 issued to Sokoloff, teaches a full sized blade coupled with a reduced size trimming blade, mounted opposite each other for easy access. The Sokoloff razor is not a bi-directional device. A push-pull bi-directional razor for shaving is described in U.S. Pat. No. 5,865,189 issued to which has a pair of mirror image blades affixed to a stick handle and describes a method of pushing and pulling the blades against ones skin by moving the handle in one direction and then another. Pushing a razor blade at the end of a stick handle up and against ones face allows for bi-directional use, but may not have the stability of the normal shaving direction.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

Figure 1A:
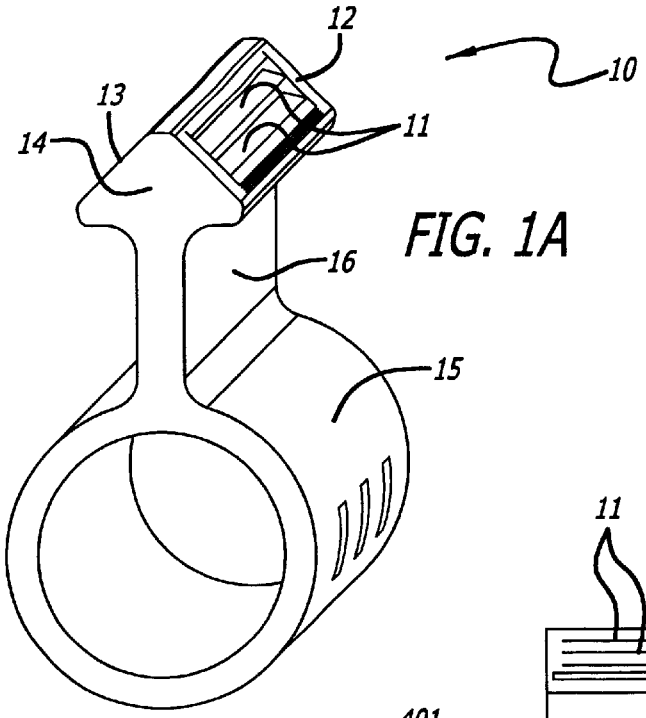
FIG. 1A is a perspective view of one embodiment of the rolling razor.

Referring now to the drawings, there is illustrated in FIG. 1A a perspective view of the rolling razor generally designated 10. This first embodiment is a disposable razor for shaving. The non-replaceable shaving blades 11 are affixed to the front and back sides 12 & 13 of the bi-directional shaving head 14 which is connected to the ring shaped handle 15 via a short planar member forming a neck 16.

Figure 1D:
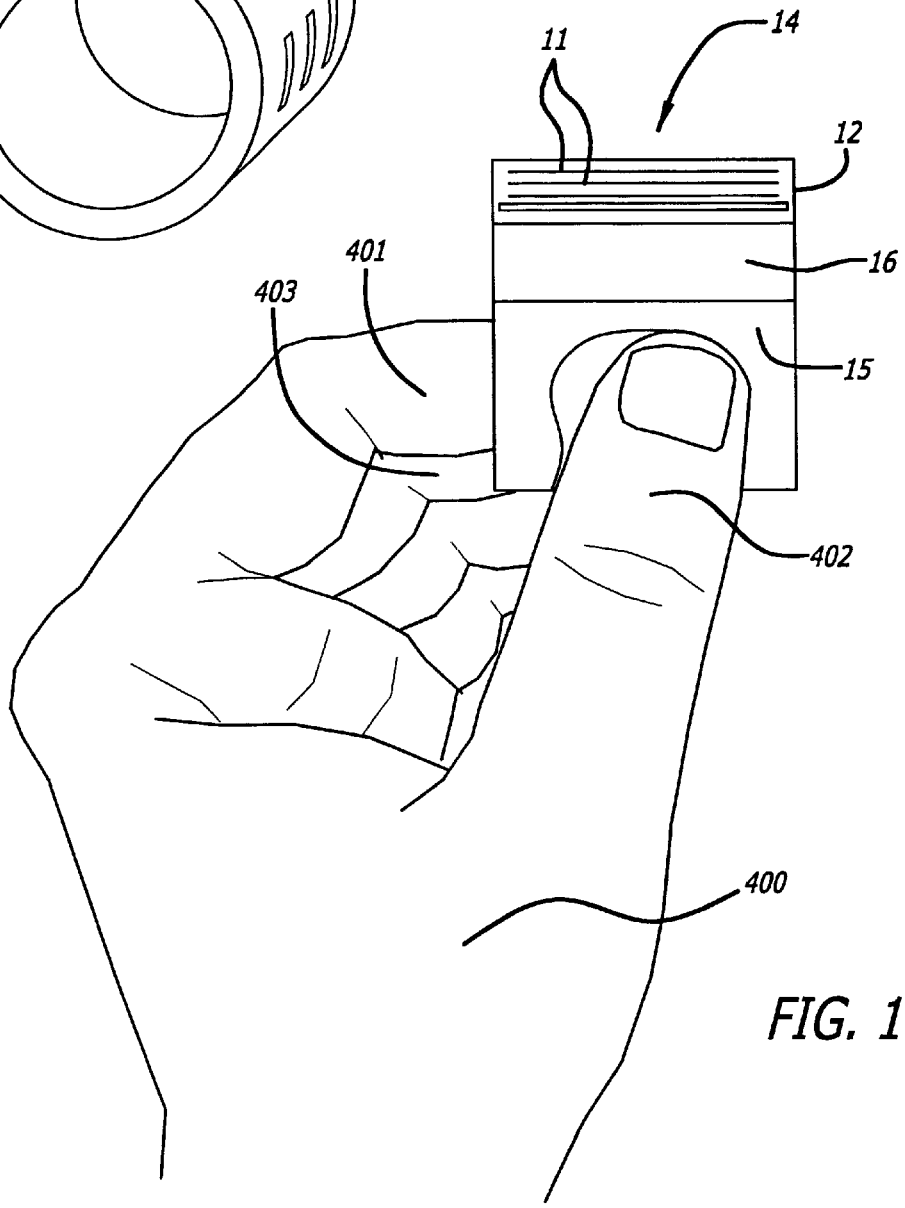
FIG. 1D is a front view of the embodiment of FIG. 1A.
Figure 1C:
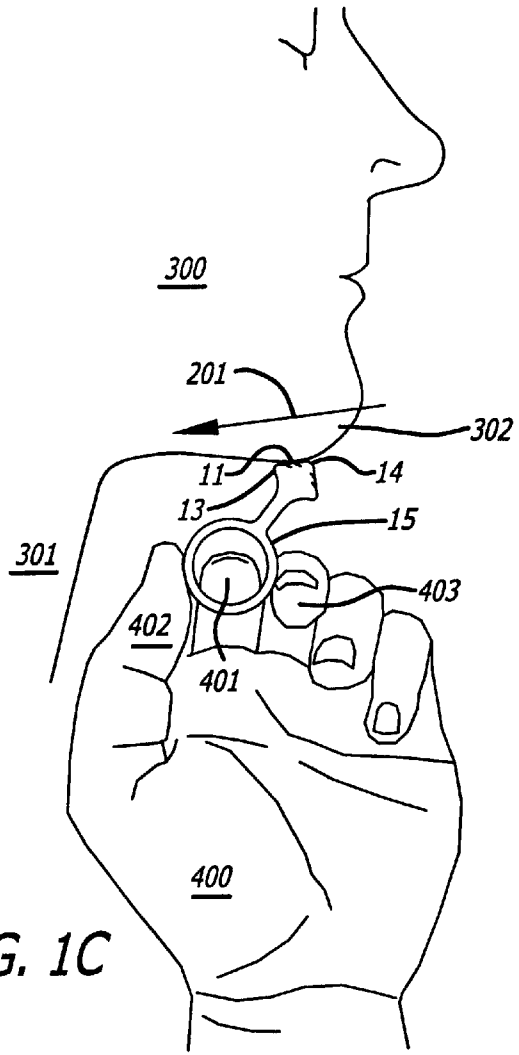
FIGS. 1B and 1C are side views of the method of operation of the embodiment of FIG. 1A.
Figure 1B:
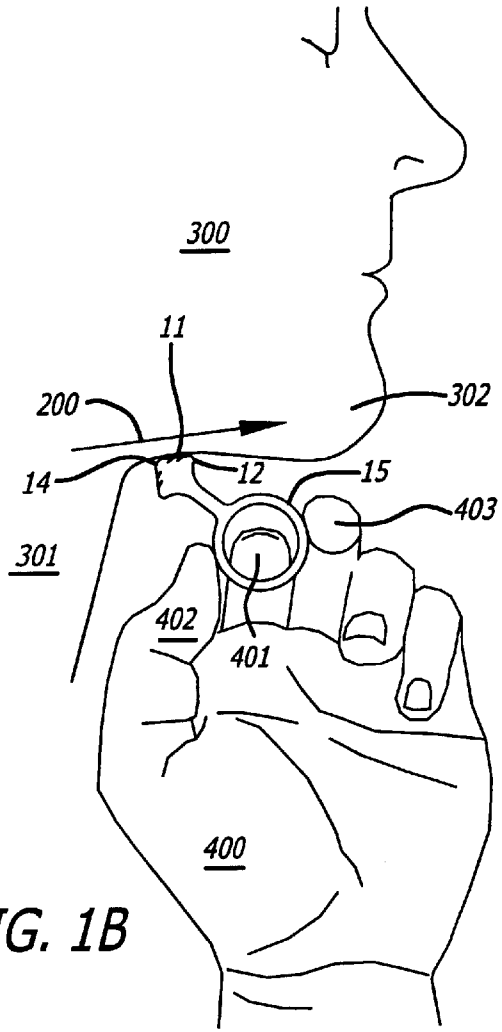

Referring now to FIGS. 1B, 1C and 1D there is illustrated two side views and one front view of the method of operation of the preferred embodiment 10. A user will hold the rolling razor 10 in his hand 400 by inserting his index finger 401 inside the ring shaped handle 15. The thumb 402 and middle finger 403 rest against opposite sides of the outer surface of the ring-shaped handle 15 and are used to incrementally control the rotation of the bi-directional shaving head 14 in relation to the index finger 401, by rolling the ring shaped handle 15 with the thumb 402 and middle finger 403.

FIG. 1B illustrates a downward stroke from neck 301 to chin 302 along the line of arrow 200. The downward stroke is a pulling stroke with the bi-directional shaving head 14 following the hand 400 and the blades 11 attached to the front side 12 of the bi-directional shaving head 14 are drawn against the beard.

FIG. 1C illustrates the return stroke which may occur without lifting the bi-directional shaving head 14 from the face 300. The return stroke along the line of arrow 201 is accomplished by completing the downward stroke and then incrementally rolling the bi-directional shaving head 14 around the index finger 401, (with the help of the thumb 402 and middle finger 403 illustrated in FIG. 1D), until the blades 11 affixed to the back side 13 are placed in contact with the face 300. The return stroke is shown from the chin 302 to neck 301 and is also a pulling stroke with the bi-directional shaving head 14 once again following the hand 400. It is envisioned that without departing from the intended scope of this invention, a plethora of blade and ring shaped handle configurations may be used as the support for a unidirectional or bi-directional shaving head and method. A significant feature of this invention is the incremental movement of the arched, or circular handle, with blades attached, around one or more fingers.

Figure 2:
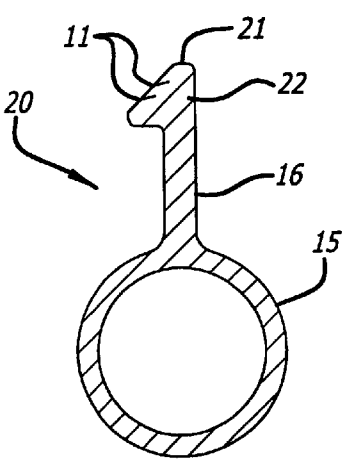
FIG. 2 is a cut-away side view of a first alternate embodiment of the rolling razor.

Referring now to FIG. 2, there is illustrated a cut-away side view of a first alternate embodiment of the rolling razor, generally designated 20. This embodiment shows a disposable razor for shaving. The non-replaceable shaving blades 11 are affixed to the front 21 of the unidirectional shaving head 22 which is connected to the ring shaped handle 15 via a short neck 16.

Figure 3B:
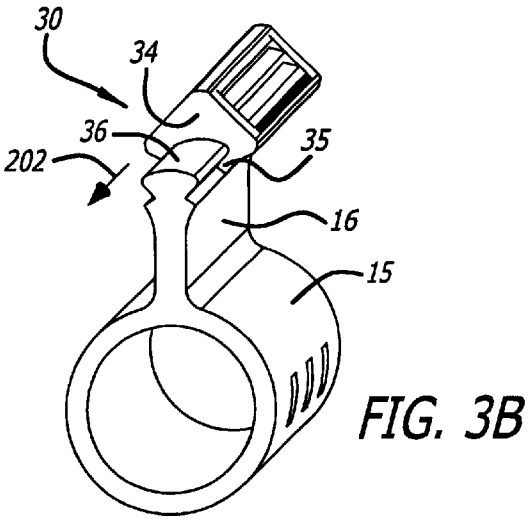
FIG. 3B is an assembly view of the embodiment of FIG. 3A.
Figure 3A:
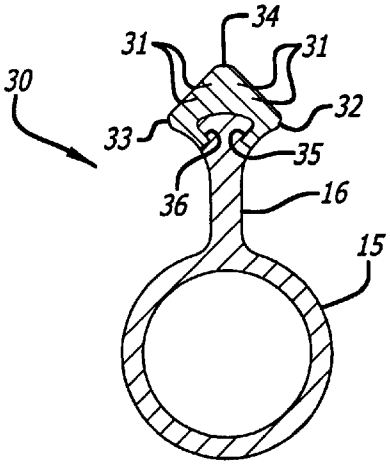
FIG. 3A is a cut-away side view of a second alternate embodiment of the rolling razor.

Referring now to FIG. 3A, there is illustrated a cut-away side view of a second alternate embodiment of the rolling razor, generally designated 30. This embodiment shows a razor for shaving, which uses replaceable shaving blades. The shaving blades 31 are affixed to the front 32 and rear 33 of the replaceable bi-directional shaving head 34 which is connected to the ring shaped handle 15 via a latch and catch arrangement 35 & 36 between the base of the replaceable bi-directional shaving head 34 and the top of the short neck 16.

Referring now to FIG. 3B there is illustrated an assembly view of the embodiment of FIG. 3A, generally designated 30. The latch 35 on the base of the replaceable bi-directional shaving head 34 mates with the catch 36 on the top of the short neck 16, by sliding the replaceable bi-directional shaving head cartridge 34 along the line of arrow 202 a new cartridge may be added. A stopping catch (not shown) limits the insertion of the replaceable bi-directional shaving head cartridge 34 to a pre-selected distance on the short neck 16. Reversing the process allows the user to replace the replaceable bi-directional shaving head cartridge 34.

Figure 3C:
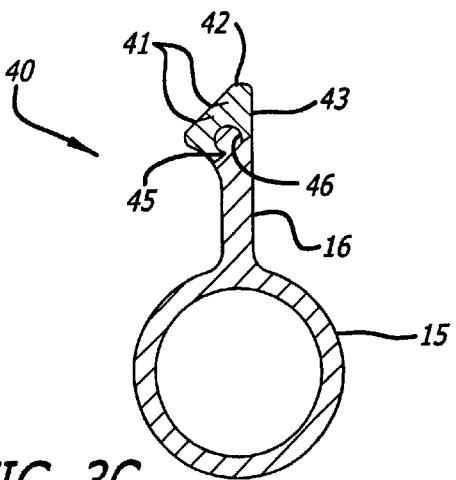
FIG. 3C is a cut-away side view of a unidirectional embodiment of the embodiment of FIG. 3A.

Referring now to FIG. 3C, there is illustrated a cut-away side view of a unidirectional embodiment of the embodiment of FIG. 3A, generally designated 40. This embodiment shows a unidirectional razor for shaving, with a replaceable shaving head cartridge. The shaving blades 41 are affixed to the front 42 of the replaceable unidirectional shaving head cartridge 43 which is connected to the ring shaped handle 15 via a latch and catch arrangement 44 & 45 between the base of the replaceable unidirectional shaving head cartridge 43 and the top of the short neck 16.

Figure 4:
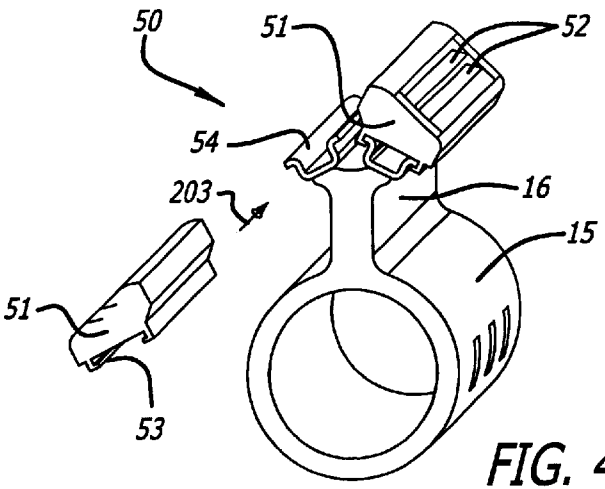
FIG. 4 is an assembly view of a third alternate embodiment of the rolling razor.

Referring now to FIG. 4 there is illustrated an assembly view of a third alternate embodiment of the rolling razor, generally designated 50. In this embodiment a dual latch and catch system is used to support two opposite slide-on blade cartridges 51. Each slide-on blade cartridges 51 has a pair of razor blades 52 affixed therein, a latch 53 formed at the base of each slide-on blade cartridges 51 mates with the a catch 54 affixed to, or formed as part of, the top of the short neck 16, by sliding the slide-on blade cartridges 51 along the line of arrow 203 each new cartridge may be added. A stopping catch (not shown) limits the insertion of the slide-on blade cartridges 51 to a pre-selected distance on the short neck 16. Reversing the process allows the user to replace the slide-on blade cartridges 51. The short neck 16 is formed as part of, or attached to, the ring shaped handle 15 thereby completing the device.

Figure 5:
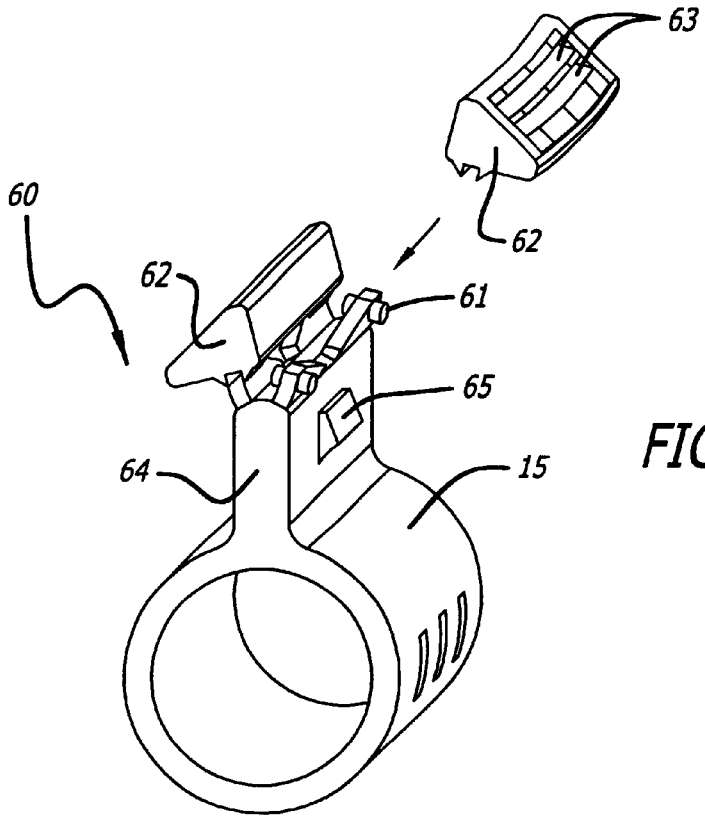
FIG. 5 is an assembly view of a fourth alternate embodiment of the rolling razor.

Referring now to FIG. 5 there is illustrated an assembly view of a fourth alternate embodiment of the rolling razor, generally designated 60. In this embodiment a dual horizontal latch and catch system 61, which mates with a Schick™ refill cartridge, is used to support two opposite latch-on refill cartridges 62. The dual horizontal latch and catch system 61 is known art and therefore a detailed description of its construction and usage is not included. Each refill cartridge 62 has a pair of razor blades 63 affixed therein. Each refill cartridge 62 mates with a horizontal latch and catch 61 thereby affixing the refill cartridges 62 to one end of a short hollow neck 64. Within the short hollow neck 64 is housed a part of the dual horizontal latch and catch system 61. A mounting lever 65, also known art, extends on each side of the short hollow neck 64. When engaged the mounting lever 65 urges a movement of the connected horizontal latch and catch to either grasp or release the refill cartridge 62. The short hollow neck 64 is affixed at one end to the ring shaped handle 15.

Figure 6:
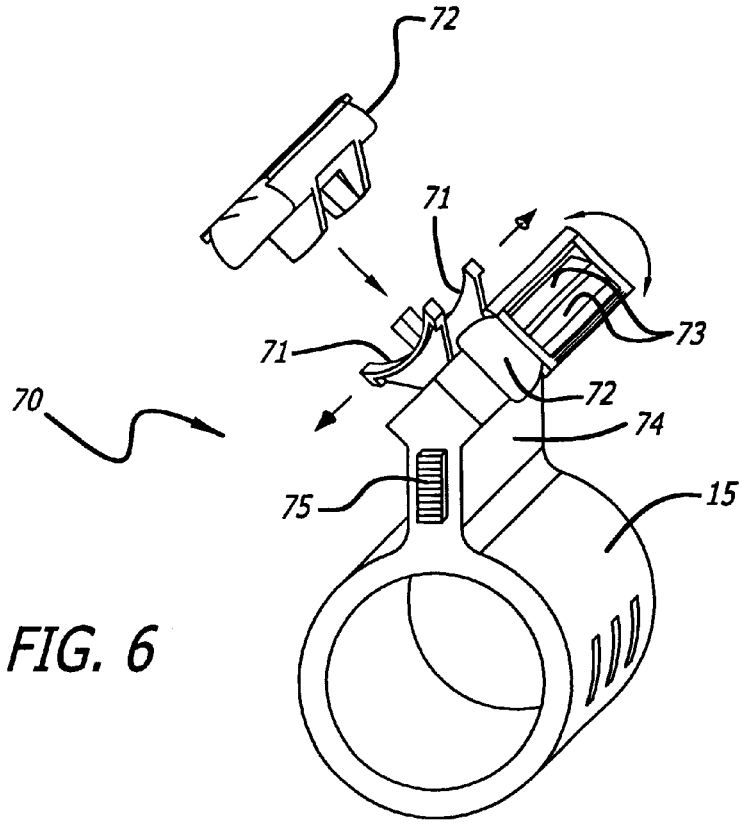
FIG. 6 is an assembly view of a fifth alternate embodiment of the rolling razor.

Referring now to FIG. 6 there is illustrated an assembly view of a fifth alternate embodiment of the rolling razor, generally designated 70. In this embodiment a dual vertical latch and catch system 71, which mates with a Gillette™ refill cartridge, is used to support two opposite latch-on refill cartridges 72. The dual vertical latch and catch system 71, is known art and therefore a detailed description of its construction and usage is not included. Each refill cartridge 72 has a pair of razor blades 73 affixed therein. Each refill cartridge 72 mates with a vertical latch and catch 71 thereby affixing the refill cartridges 72 to one end of a short hollow neck 74. Within the short hollow neck 74 is housed a part of the dual vertical latch and catch system 71. A mounting switch 75, also known art, extends on each side of the short hollow neck 74. When engaged the mounting switch 75 urges a movement of the connected vertical latch and catch to either grasp or release the refill cartridge 72. The short hollow neck 74 is affixed at one end to the ring shaped handle 15.

Figure 7:
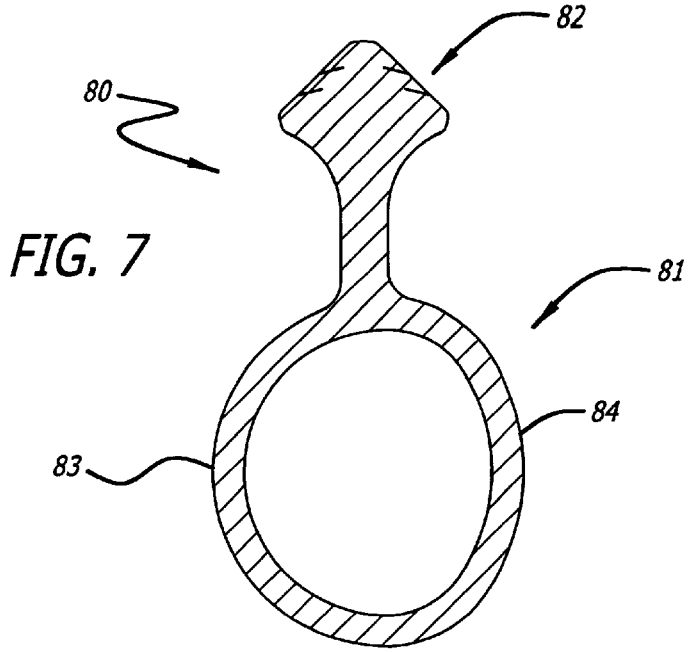
FIG. 7 is a cut-away side view of a sixth alternate embodiment of the rolling razor.

Referring now to FIG. 7 there is illustrated a cut-away side view of a sixth alternate embodiment of the rolling razor, generally designated 80. This embodiment shows an ovoid ring handle 81 with a bi-directional shaving head 82. The ovoid handle 81, which allows the user to choose the small radius curvature side of the ovoid handle 83 or the larger radius curvature side of the ovoid handle 84 depending on which best fits their hand and fingers. It is envisioned that a unidirectional shaving head mounted to the ovoid handle 81, would fall within the intended scope of this invention.

Figure 8A:
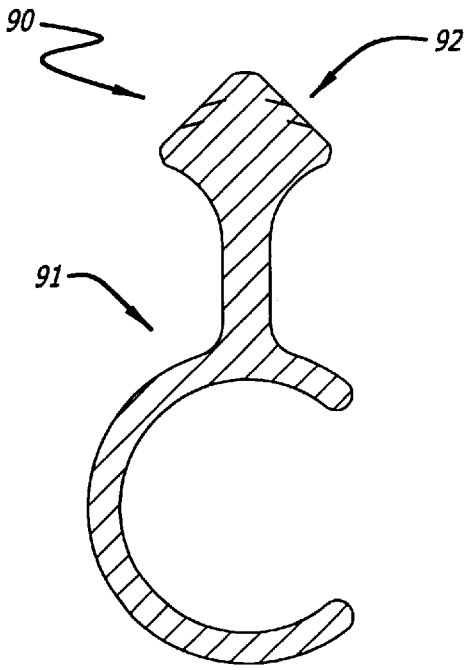
FIG. 8A is a cut-away side view of a seventh alternate embodiment of the rolling razor.
Figure 8B:
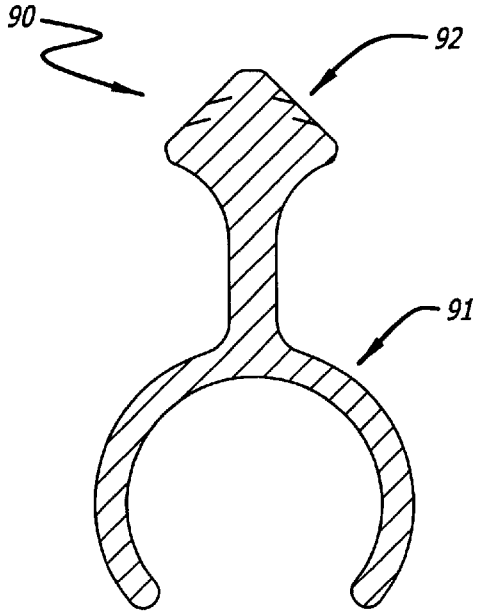
FIG. 8B is a cut-away side view of an alternate embodiment of the embodiment of FIG. 8A.

Referring now to FIGS. 8A and 8B there are illustrated cut-away side views of a seventh alternate embodiment of the rolling razor, generally designated 90. Each embodiment shows a partial ring handle 91 with a bi-directional shaving head 92. The partial ring handle 91 may be open on the (FIG. 8A) or open at the bottom (FIG. 8B). It is envisioned that a unidirectional shaving head mounted to the partial ring handle 91, would fall within the intended scope of this invention.

Figure 9:
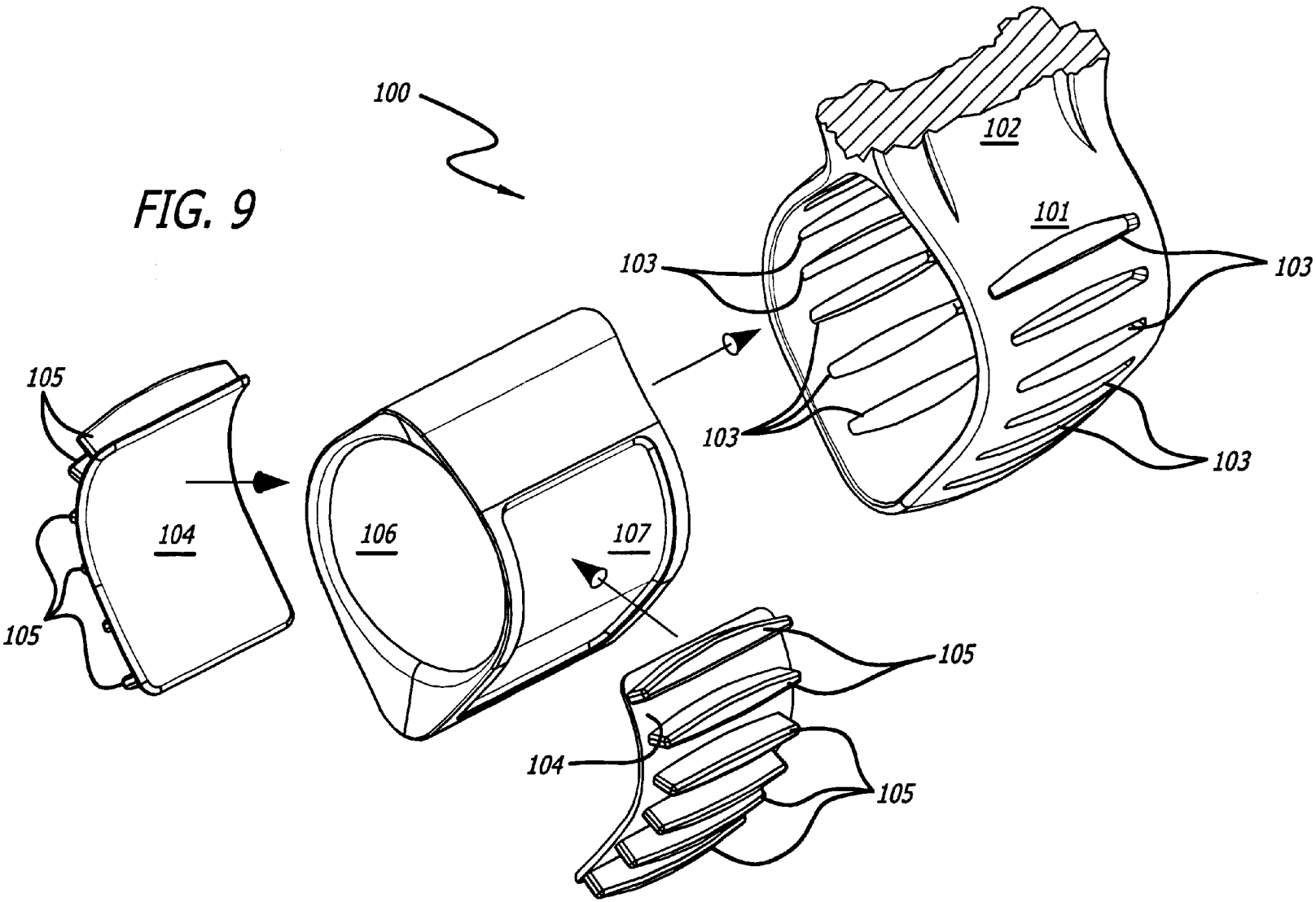
FIG. 9 is an alternate embodiment of the ring handle for the rolling razor.

Referring now to FIG. 9 there is illustrated an alternate embodiment of the ring handle for the rolling razor generally designated 100. In one embodiment, the handle casing 101 is an injection molded part 101. Various suitable thermoplastics are known in the art. Alternatively, handle casing may be machined from various plastics or metal such as aluminum. In one embodiment, handle casing defines a substantially diamond shaped volume. A short neck 102 (partially revealed in this illustration) extends from the handle casing 101 and the shaving head (shown in FIG. 10) is affixed thereto. A series of griping guides 103 are formed through each side of the handle casing 101 and a pair of molded soft gripping members 104 with a gripping surface of a plurality of gripping ridges 105, each of a size and shape to extend through the griping guides 103 and are inserted in to the gripping guides 103 from the inside of the ring towards the outside. In another embodiment, gripping guides 103 do not perforate the handle casing 101. Rather, a plurality of indentations are formed on casing 101 to which gripping ridges 105 may be adhered.

A comfort sleeve 106, molded from a relatively soft and tactile material forms an internal gripping surface. In one embodiment, comfort sleeve 106 may be fitted neatly within the handle casing 101 and prohibits removal of the soft gripping members 104 by placing the soft gripping members 104 in a grip catch 107. In one embodiment, both gripping member 104 and comfort sleeve 106 are molded from an elastomeric material. In one embodiment, the comfort sleeve is extruded rather than molded. In one embodiment, both comfort sleeve 106 has gripping ridges formed integrally thereon to extend through gripping guides 103. Comfort sleeve 106 defines a substantially cylindrical volume to receive an index finger of a user. The inner surface of comfort sleeve 106 is typically substantially smooth to facilitate rotation of the assembly about the finger during use. Again, to facilitate rotation during use, the cylindrical diameter should exceed the expected finger diameter and avoid a snug fit. A diameter of 0.8 inches has been found suitable for most users. Different diameter may be achieved by varying the wall thickness of the comfort sleeve.

Figure 10:
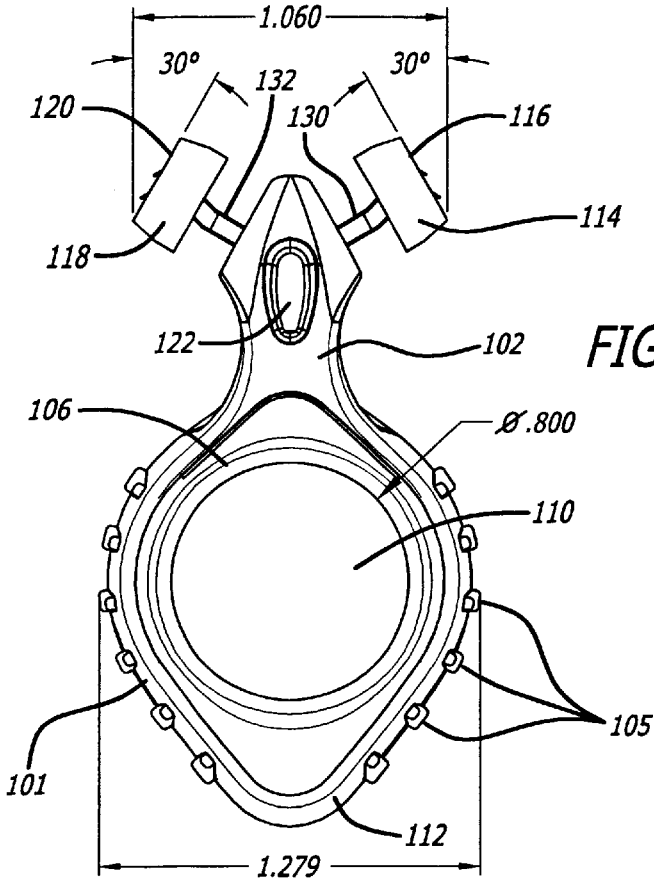
FIG. 10 is a left-side view of a razor of one embodiment of the invention.

FIG. 10 is a left-side view of a razor of one embodiment of the invention. While FIG. 10 shows certain specific dimensions, other dimensions are within the scope and contemplation of the invention. Handle casing 101 defines a volume which is occupied by comfort sleeve 106. Comfort sleeve 106 defines an arcuate volume 110, in this example a substantially cylindrical volume. Substantially cylindrical volume 110 may have a diameter of 0.8 inches in one embodiment. Gripping ridges 105 protrude from both sides of handle casing 101. Handle casing 101 defines a tail 112 extending from the body region. Tail 112 provides an extension from the arcuate volume 110 which permits improved leverage by either user's middle finger or thumb to facilitate rotation about an index finger occupying the volume 110. In one embodiment, the razor is symmetric right to left and front to back. This facilitates use by either hand and ensure proper orientation regardless of direction of finger insertion.

Handle casing 101 also defines a short neck 102 extending from a body region of the casing 101. A first and second receiver 130, 132 are coupled to the neck 102. The receivers 130, 132 may be any of the types discussed above for receiving various types of existing blade assemblies. As used herein, a blade assembly includes at least one razor blade suitable for removing hair growth. A first blade assembly 114 may be coupled to a first receiver 130 and have a face 116 defining the plane along which cutting may occur. Receiver 130 may permit blade assembly 114 to pivot or may retain it in a fixed orientation relative to the neck 102. A release button 122, it is provided to release first blade assembly 114. Receiver 130 may include a spring bias within the neck to cause the receiver 130 to engage and retain blade assembly 114 when the release button 122 is not depressed.

In one embodiment, in steady state, face 116 of blade assembly 114 defines an angle of 30 degrees with the vertical. As used herein, "vertical" is defined based on the orientation of FIG. 10. A vertical plane is any plane that would be parallel to a symmetrical bisector in FIG. 10. Similarly, receiver 132 retains a second blade assembly 118 having a face 120. The discussion above with respect to the first blade assembly applies.

In one embodiment, the maximum cross dimension of the handle casing 101 is greater than the maximum cross dimension at the first and second blade assemblies. While the symmetric embodiment is shown and described it is within the scope and contemplation of the invention of the razor to be asymmetric. For example, it is within the scope and contemplation of the invention to have only a single receiver 130 and only a first blade assembly attached thereto. It is also within the scope and contemplation of the invention for the arcuate volume 110 to have different radii of curvature from one side to the other to accommodate different finger sizes as described with reference as FIG. 7 above. It is further within the scope and contemplation of the invention that different sides may have different numbers and/or spacings of gripping ridges 105. It is also envisioned that the tail 114 may be more pronounced and some embodiments and/or differently shaped. It is also within the scope and contemplation of the invention for one or two blade assemblies to be fixedly and permanently mounted to the neck.

Figure 11:
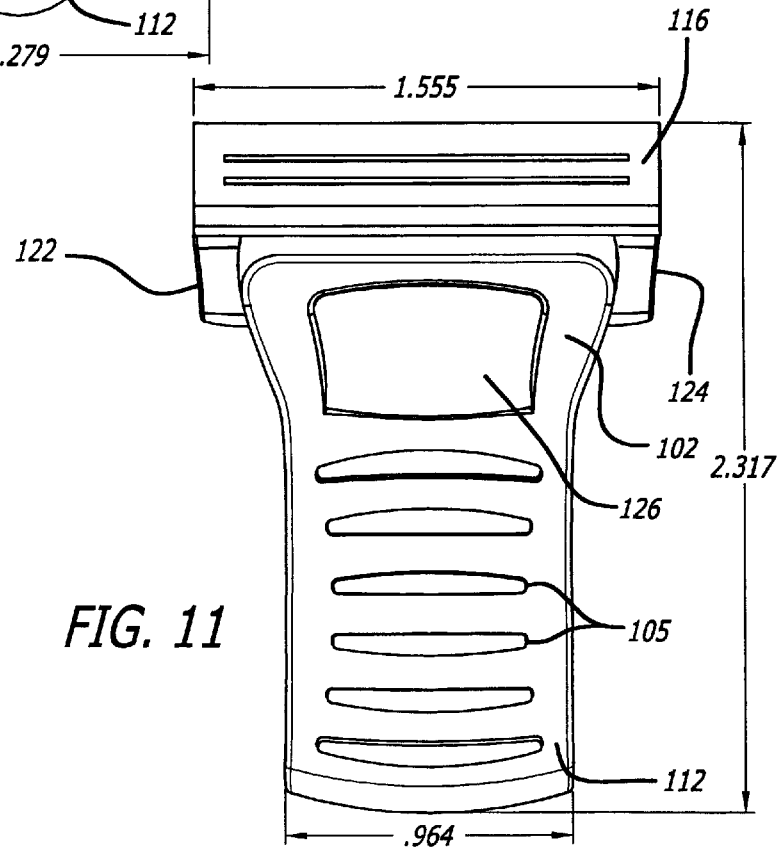
FIG. 11 is a front view of the embodiment of FIG. 10.

FIG. 11 is a front view of the embodiment of FIG. 10. Identifiable in this view is a second release button 124 corresponding to the second blade assembly 118 (shown in FIG. 10). It is also within the scope and contemplation of the invention to provide a single release for both assemblies or no release button thereby requiring manual removal such as if a receiver of one of the types described above with reference to FIGS. 3A–3C and 4. Handle casing 101 defines a control groove 126 into which a middle finger or thumb (the controlling digits) as the case may be, may seat when the opposing blade assembly is engaged in a cutting stroke as described in further detail with reference to FIG. 12 below.

Figure 13:
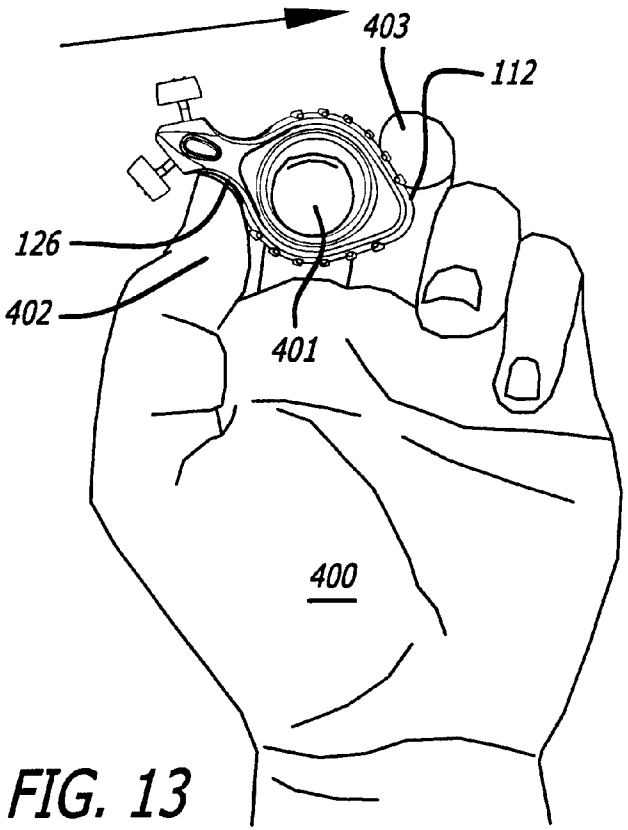
FIGS. 12 & 13 illustrate the manipulation of the razor from a down stroke to an up stroke for the embodiment of FIG. 10.
Figure 12:
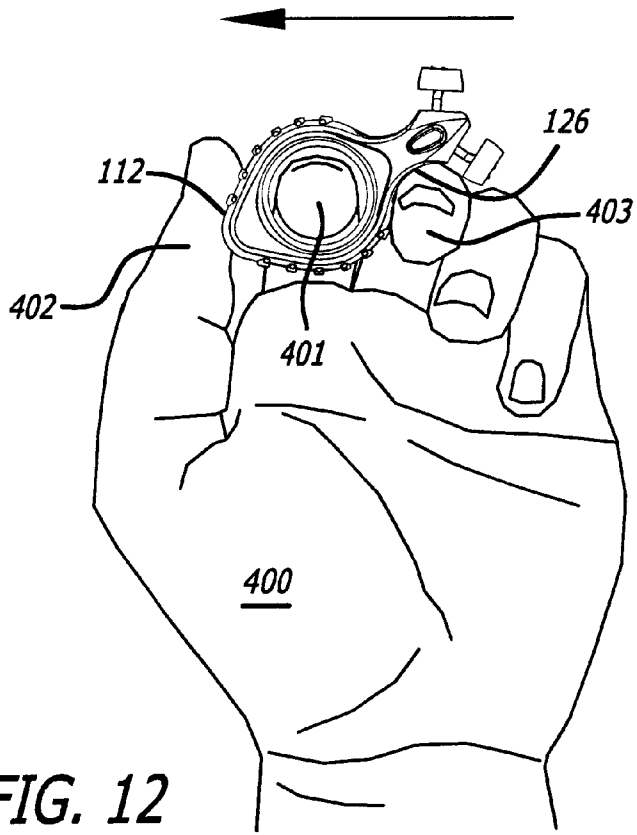

FIGS. 12 & 13 illustrate the manipulation of the razor from a first direction of stroke to a second direction of stroke for the embodiment of FIG. 10. This directional change may be, for example, down stroke to up stroke or left stroke to right stroke. In use a user typically inserts his index finger 401 up to the first knuckle into the arcuate volume 110. The index finger alone does not retain the razor thereon. Rather, pressure between the thumb 102 and either the index finger 401 or opposing middle finger 403 retains the razor on the index finger 401. The index finger 401 provides an axis for rotation responsive to pressure applied by the adjacent controlling digits. Keeping the razor toward the distal end of the inserted finger permits finger tip control by the controlling digits. Thus, for example, control of rotation, pressure, and face pitch are derived from the finger tips of middle finger 403 and thumb 402. As shown during the initial down stroke, the user's thumb 402 tends to migrate down towards the tail 112 while the middle finger 403 seats in the control groove 126. At the conclusion of the down stroke, the middle finger migrates towards the tail 112 while the thumb migrates toward the control groove 126 with concurrent rotation about the index finger 401 inserted into the arcuate volume 110. On a subsequent up stroke, the thumb 402 will seat in control groove 126. This seating of a controlling digit in a control groove 126 as shown provides for a very precise control of the pressure and fine angle at the face of the opposing blade assembly. The other of the controlling digit will typically migrate down onto the tail 112 opposite the control groove, thereby providing good rotational stability and enhancing the fine rotational control. A similar pattern of finger movement is followed for a right handed user going from left stroke to right stroke or a left handed user going from right stroke to left stroke.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. A shaving razor comprising:

a body defining an arcuate region to receive a finger of a user;

a neck extending from the body;

a first blade assembly having a face defining a first plane, the first blade assembly coupled to the neck;

a second blade assembly having a face defining a second plane, the second blade assembly coupled to the neck; and a first release button and a second release button to release the first blade assembly and second blade assembly respectively.

2. A shaving razor comprising:

a body defining an arcuate region to receive a finger of a user;

a neck extending from the body;

a first blade assembly having a face defining a first plane, the first blade assembly coupled to the neck;

a second blade assembly having a face defining a second plane, the second blade assembly coupled to the neck; and a tail extending from the body.

3. The shaving razor of claim 2 wherein the body, neck and tail comprise:

a handle casing; and a comfort sleeve.

4. A shaving razor comprising:

a body defining an arcuate region to receive a finger of a user;

a neck extending from the body;

a first blade assembly having a face defining a first plane, the first blade assembly coupled to the neck;

a second blade assembly having a face defining a second plane, the second blade assembly coupled to the neck; and a plurality of gripping ridges dispose along the body.

5. The shaving razor of claim 1 wherein the neck defines a control groove into which a controlling digit may seat.

6. The shaving razor of claim 3 wherein the handle casing is a thermoplastic and the comfort sleeve is elastomeric.

7. A shaving razor comprises:

a body defining an arcuate region to receive a finger of a user;

a neck extending from the body;

a first blade assembly having a face defining a first plane, the first blade assembly coupled to the neck;

a second blade assembly having a face defining a second plane, the second blade assembly coupled to the neck; and wherein the razor is symmetric about two axes.

8. A shaving razor comprising:

a body defining an arcuate region to receive an index finger, the body having a first side and a second side to be engaged in opposition by a thumb and a middle finger respectively of a user, such that the thumb and middle finger control rotation about the index finger;

a neck extending from one end of the body; and a receiver coupled to the neck to retain a first blade assembly having a face defining a first plane.

9. The shaving razor of claim 8 further comprising:

a tail extending from a second end of the body opposite the neck.

10. The shaving razor of claim 8 wherein the body and neck comprise:

a handle casing; and a comfort sleeve.

11. The shaving razor of claim 8 wherein the neck defines a control groove into which a controlling digit may seat.

12. The shaving razor of claim 8 wherein an inner surface of the arcuate is substantially smooth.

13. A shaving razor comprising:

a body defining an arcuate region to receive a first finger of a user;

a neck extending from the body;

a first blade assembly coupled to the neck; and a tail extending from the body opposite the neck to improve rotational leverage of a second finger or an oppositely directed third finger controlling rotation about the first finger.

14. The shaving razor of claim 13 wherein an inner surface of the arcuate region is substantially smooth.

15. The shaving razor of claim 13 further comprising:

a second receiver coupled to the neck to retain a second blade assembly.

16. The shaving razor of claim 15 wherein the body, neck and tail comprise:

a handle casing; and a comfort sleeve.

17. The shaving razor of claim 13 wherein the neck defines a control groove into which a controlling digit may seat.

* * * * *